US009826782B2

(12) United States Patent
Okada

(10) Patent No.: US 9,826,782 B2
(45) Date of Patent: Nov. 28, 2017

(54) PENIS RETAINER AND PENIS SECURING METHOD

(76) Inventor: Shiro Okada, Matsuyama (JP)

( * ) Notice: Subject to any disclaimer, the term of this patent is extended or adjusted under 35 U.S.C. 154(b) by 1931 days.

(21) Appl. No.: 12/934,069

(22) PCT Filed: Mar. 25, 2009

(86) PCT No.: PCT/JP2009/001342
§ 371 (c)(1),
(2), (4) Date: Sep. 23, 2010

(87) PCT Pub. No.: WO2009/128204
PCT Pub. Date: Oct. 22, 2009

(65) Prior Publication Data

US 2011/0016614 A1 Jan. 27, 2011

(30) Foreign Application Priority Data

Apr. 14, 2008 (JP) ..... 2008-104213

(51) Int. Cl.
*A41B 9/14* (2006.01)
*A41B 9/02* (2006.01)
*A41B 9/00* (2006.01)

(52) U.S. Cl.
CPC ..... *A41B 9/023* (2013.01); *A41B 9/004* (2013.01); *A41B 9/02* (2013.01); *A41B 9/14* (2013.01)

(58) Field of Classification Search
CPC .. A41B 9/023; A41B 9/14; A41B 9/02; A41B 9/004
USPC ..... 2/403, 466; 600/38, 41; 604/385.09, 604/353, 393, 394, 395, 396, 397, 398, 604/399, 400, 402, 392; 602/67, 70; 128/842, 883, 885, 869, 891
See application file for complete search history.

(56) References Cited

U.S. PATENT DOCUMENTS 2,038,242 A * 4/1936 Schwartz ..... 602/67
3,229,692 A * 1/1966 Creed ..... 602/72
(Continued)

FOREIGN PATENT DOCUMENTS

JP S60-104118 U 7/1985
JP H8-49102 A 2/1996
(Continued)

OTHER PUBLICATIONS

RuPaul, Lettin it All Hang Out: An Autobiograpy, Jun. 6, 1996, Hyperion, p. 8.*
(Continued)

*Primary Examiner* — Clinton T Ostrup
(74) *Attorney, Agent, or Firm* — JTT Patent Services, LLC; Gerald T. Peters

(57) ABSTRACT

Male undergarment (penis retainer) 50 associated with one embodiment comprises tubular cloth member 55, which is a retainer main body; front connecting cord 58*a*, which is a connecting member for installing the retainer main body on a human body, one end of front connecting cord 58*a* being attached to the lower side of a front open portion of tubular cloth member 55; clip 59*a*, which is attached to the tip of front connecting cord 58*a*; back connecting cord 58*b*, one end of which is attached to the upper side of a back open portion of tubular cloth member 55; and clip 59*b*, which is attached to the tip of back connecting cord 58*b*. When securing the penis, the penis is inserted into the interior of tubular cloth member 55.

4 Claims, 13 Drawing Sheets

(56) References Cited

U.S. PATENT DOCUMENTS

| | | | | | |
|---|---|---|---|---|---|
| 4,345,337 | A | * | 8/1982 | Chung | 2/405 |
| 4,377,008 | A | * | 3/1983 | Jung | 2/403 |
| 4,471,772 | A | * | 9/1984 | Miller, Jr. | 602/67 |
| 4,526,167 | A | * | 7/1985 | Ebenal et al. | 602/70 |
| 4,622,962 | A | * | 11/1986 | Kauffman | 602/70 |
| 4,660,551 | A | * | 4/1987 | Nishimura | 600/41 |
| 4,666,440 | A | * | 5/1987 | Malfitano | 604/391 |
| 4,702,239 | A | * | 10/1987 | Ichikawa | 602/67 |
| 4,759,355 | A | * | 7/1988 | Thrower | 602/67 |
| 4,961,419 | A | * | 10/1990 | Tribble et al. | 602/70 |
| 5,094,234 | A | | 3/1992 | Searcy | |
| 5,226,179 | A | * | 7/1993 | Choi | 2/403 |
| 5,283,912 | A | * | 2/1994 | Chung | 2/403 |
| 5,647,065 | A | * | 7/1997 | Richerson | 2/403 |
| 5,797,401 | A | * | 8/1998 | Knight | 128/842 |
| 5,926,853 | A | * | 7/1999 | Plank | 2/406 |
| 6,038,703 | A | * | 3/2000 | Chung | 2/403 |
| 6,123,664 | A | * | 9/2000 | Ard | 600/38 |
| 6,662,378 | B2 | * | 12/2003 | Vartanyan | 2/403 |
| 6,849,041 | B2 | * | 2/2005 | Astin | 600/38 |
| 6,862,746 | B2 | * | 3/2005 | Cym et al. | 2/403 |
| 6,901,607 | B1 | * | 6/2005 | Elwell | 2/403 |
| 7,434,273 | B2 | * | 10/2008 | Chung | 2/403 |

FOREIGN PATENT DOCUMENTS

| | | | | | |
|---|---|---|---|---|---|
| JP | 2001-299794 | A | | 10/2001 | |
| JP | 2003-111788 | A | | 4/2003 | |
| JP | 2005-23486 | A | | 1/2005 | |
| JP | 2007-70785 | A | | 3/2007 | |
| JP | 3143285 | U | | 7/2008 | |
| JP | 2010150740 | A | * | 7/2010 | A41B 9/023 |

OTHER PUBLICATIONS

International Search Report in International Application No. PCT/JP2009/001342, of which the present application is the national stage (included among documents submitted on filing of 371 application and/or forwarded to PTO from IB).

International Preliminary Report on Patentability/Written Opinion in International Application No. PCT/JP2009/001342, of which the present application is the national stage.

* cited by examiner

PENIS RETAINER AND PENIS SECURING METHOD

TECHNICAL FIELD

The present invention relates to a penis retainer and a penis securing method for securing the male penis.

BACKGROUND ART

While, in pursuit of comfort and the like, various types of undergarment have conventionally been provided as male lower body undergarments, almost all of these have ordinarily been undergarments that retain the penis and scrotum in their natural state, which is downwardly directed due to gravity.

In contrast, Patent References Nos. 1 through 3, below, disclose male lower body undergarments that use special methods to retain the penis.

Patent Reference No. 1: Japanese Patent Application Publication Kokai No. 2003-111788

Patent Reference No. 2: Japanese Patent Application Publication Kokai No. 2005-23486

Patent Reference No. 3: Japanese Patent Application Publication Kokai No. 2007-70785

Patent Reference No. 1 discloses a male absorbent article for use by incontinent patients, infants, bedridden elderly persons, and so forth, the male absorbent article comprising a worn part having a hole portion formed on a front surface thereof from which the penis protrudes to the exterior when worn, and a pouch part removably installed on the outside of this hole portion and into which the penis which protrudes to the exterior from the hole portion is inserted.

Patent Reference No. 2 discloses a male undergarment which when worn is capable of preventing blistering and of preventing slippage beneath the undergarment, which is especially suitable for being worn when exercising, and which has a generally pouch-like scrotum-containing part at a crotch part of the undergarment main body, and which has a generally annular penis-supporting flange part mounted at an outside circumferential portion of a hole at the front of the undergarment main body.

Patent Reference No. 3 discloses male underpants which cause the penis to be disposed at a suitable location, which do not interfere with movement of the body during sports or vigorous exercise, and which reduce discomfort due to moisture, blistering, and so forth, the male underpants having mounted at the front of the main body thereof a penis-containing pocket for securing the penis in upwardly directed fashion.

DISCLOSURE OF THE INVENTION

Problems to be Solved by the Invention

Conventional male undergarments of the ordinary sort as well as the male undergarments disclosed at the foregoing Patent References Nos. 1 through 3 provide a certain degree of comfort. However, there is demand for a penis retainer that will provide even more exhilaration, comfort, and so forth. It is therefore an object of the present invention to provide a conventionally unavailable novel penis securing method and a penis retainer for implementing this novel penis securing method.

Means for Solving the Problems

To solve the above problems, a penis retainer associated with the present invention is a penis retainer for securing a penis by tucking the penis into a crotch area, being characterized in that it comprises a tubular cloth member mounted below the crotch when installed on a human body and allowing the penis to be inserted into an interior space from a front opening thereof; and a connecting member for installing the tubular cloth member on the human body, the connecting member having a front connecting cord, one end of which is attached to the front of the tubular cloth member; and a back connecting cord, one end of which is connected to the back of the tubular cloth member; wherein the penis retainer is constituted such that when installed on the human body, installation of the tubular cloth member is made to proceed as a front portion and a back portion of the tubular cloth member mounted below the crotch are pulled upward by securing the other ends of the front connecting cord and the back connecting cord to the human body and/or a member installed on the human body.

Furthermore, a penis securing method associated with the present invention is a penis securing method employing the foregoing penis retainer to secure a penis by tucking the penis into a crotch area, being characterized in that the penis is secured by tucking the penis into the crotch area by pulling the penis backward from below and causing a foreskin to retract so as to completely expose a glans penis, and with the penis pulled backward in this state, using an inside bottom surface of the tubular cloth member to surfacially press upward a front side of a region from a vicinity of a base of the penis to a corona glandis thereof, and in addition, capturing the corona glandis at the front side with an edge region at a back end of the tubular cloth member so as to prevent the penis from returning to a forward location.

Effect of the Invention

The penis securing method associated with the present invention makes it possible, without imparting discomfort to the wearer, to reliably and stably secure the penis by tucking it into the crotch area.

BEST MODES FOR CARRYING OUT THE INVENTION

With reference to the drawings, embodiments of the present invention will be described in detail below.

(1) Embodiment 1

A first embodiment of the present invention is first described with reference to the drawings. FIG. 1 is a perspective view of a male undergarment associated with the first embodiment. FIGS. 2A and 2B respectively show strap-like cloth members 22, 25 which make up a retainer main body in the male undergarment associated with the first embodiment, the respective strap-like cloth members 22, 25 of the retainer main body being shown as they would appear when spread out. FIG. 3 is a sectional view showing the male undergarment associated with the first embodiment as it appears when worn.

As shown in FIG. 1, a male undergarment (penis retainer) 10 associated with the present embodiment is equipped with a first strap-like cloth member 22 and a second strap-like cloth member 25 constituting a retainer main body, and with a hoop-like waist cord 20 that functions as connecting member for installing the retainer main body on a human body. The front and back edge regions of strap-like cloth members 22, 25 are secured by stitching to the front center region and to the back center region of waist cord 20, such that first strap-like cloth member 22 is secured to the inside, and second strap-like cloth member 25 is secured to the outside. Of course, strap-like cloth members 22, 25 may be secured to waist cord 20 by method(s) other than stitching. For example, they may be removably secured thereto by means of a surface fastener, i.e., Velcro tape (registered trademark).

As respectively shown in FIGS. 2A and 2B as they would appear when spread out, strap-like cloth members 22, 25 are long, thin cloth members that are strap-like in shape, the side edge regions in the long direction thereof being folded over toward the interior. Because the side edge regions of the cloth members are thus folder over toward the interior, this makes it possible when installed on the human body to cover the penis in such manner that it is also enveloped from the sides.

Formed at a central region of first strap-like cloth member 22 is an insertion hole 22*a* that is on the order of 4 cm in diameter, this insertion hole 22*a* being located at the bottom of the retainer main body of male undergarment 10 as shown in FIG. 1. As described below, when male undergarment 10 is installed on a human body, the glans portion at the tip of the penis is made to protrude to the exterior of first strap-like cloth member 22 from this insertion hole 22*a*.

At such time, the inside surface of the first strap-like cloth member is in contact with and clings tightly to the front side of the penis, over a region from the base thereof to just short of the glans penis, such that the penis is tucked into the crotch area as a result of this surface contact. What is referred to here as the front side of the penis is the side thereof that faces outward when the non-erect penis is allowed droop down naturally, this being the side opposite the back side at which the frenulum of the penis (frenulum preputii penis) is located.

Furthermore, the front edge region of insertion hole 22*a* captures the front side of the corona glandis and also serves to pull the glans portion of the penis toward the rear. Furthermore, because the glans portion protruding from insertion hole 22*a* is straddled between and enveloped by first strap-like cloth member 22 and second strap-like cloth member 25, this is accomplished without causing the glans portion to be exposed at the exterior of male undergarment 10. Furthermore, because the glans portion is also pressed on by surface contact from the second strap-like cloth member 25, it is possible to more stably retain the penis.

Here, considering the feel thereof against the skin, first strap-like cloth member 22 and second strap-like cloth member 25, constituting male undergarment 10 associated with the present embodiment, are silk (silken) woven fabrics. Furthermore, waist cord 20 is made of rubber so that it can be definitively secured about the waist. Of course, it being possible to employ any other material as appropriate as material for male undergarment 10 provided that it is a material that offers no impediment despite being in direct contact with the skin, besides woven fabrics it is possible to use knit fabrics, laces, felts, nonwoven fabrics, and so forth.

Next described is a sequence that may be adopted to secure the penis when male undergarment 10 is installed on a human body. Both feet are first passed through the center of waist cord 20 so as to cause the retainer main body to be straddled between the feet. Waist cord 20 is then pulled up to almost as far as the waist, following which the wearer uses his hand(s) to pull the penis from below, stretching it backward almost as far as its length when erect, and with the penis in this state, retracts the foreskin and inserts the exposed glans portion into insertion hole 22*a* of first strap-like cloth member 22.

With the tip of the penis inserted in insertion hole 22*a* in this fashion, when waist cord 20 is pulled up as far as the waist to completely install male undergarment 10 on the lower body, the front side of the penis is pressed upward by the inside surface of first strap-like cloth member 22, and the front edge region of insertion hole 22*a* which is formed at the bottom of the retainer main body captures the front side of the corona glandis of the exposed glans portion and pulls the penis backward, the penis being secured and retained in this state.

At FIG. 3, which shows a sectional view of male undergarment 10 as it appears when worn, the glans portion at the tip of the penis is captured by the front edge region of insertion hole 22*a* and is pulled backward, and the back side of the region from the vicinity of the base of the penis to the glans thereof is secured as a result of being tucked into the crotch area by the inside surface of first strap-like cloth member 22. Although not shown at FIG. 3, when the penis is tucked into the crotch area, this causes the scrotum to be straddled between the penis and the crotch area. At this time, note that the penis is located between the two testes, the two testes being displaced to either side by presence of the penis therebetween.

Furthermore, the inside surface of second strap-like cloth member 25 is in intimate contact with and presses upward on the outside surface of first strap-like cloth member 22 and the exposed glans penis which protrudes from insertion hole 22*a*. This makes it possible for the penis to be secured by the full expanse of the first strap-like cloth member, permitting the penis to be secured in stable fashion so that situations such as might otherwise occur were the penis to move forward and the glans penis to come free of insertion hole 22*a* or the like can be prevented. Furthermore, because the glans portion is also pressed on by surface contact, it is possible to more stably retain the penis.

By thus retaining the penis in a state in which the glans penis, from which the foreskin has been retracted, has been pulled backward from below and tucked into the crotch area, the penis securing method associated with the present embodiment makes it possible for the penis and the scrotum to be reliably secured with respect to the human body. Therefore, even when engaged in sports or other such vigorous activity, there will be no interference or unpleasant sensation due to movement of either the penis or the scrotum.

Furthermore, when securing the penis in the present embodiment, because the front side of a region from the base of the penis to the corona glandis is pressed on by surface contact from cloth member(s), and because the corona glandis is captured and secured by an edge region of a hole in a cloth member, it is possible to secure the penis in stable fashion without imparting pain or discomfort to the wearer.

In addition, in the present embodiment, the non-erect penis (penis in a state in which blood does not adequately fill the corpus cavernosum) is retained and secured by the male undergarment in such fashion that the penis is stretched to a length that is almost its length when erect, permitting the wearer to enjoy a certain type of exhilaration or pleasure. Note that what is referred to in the present specification as a length that is almost the length when erect means a length that is not less than on the order of 70 percent of the length when fully erect. Furthermore, because in accordance with the present embodiment the penis does not bulge toward the front, the male undergarment of the present embodiment is also prized by transgender individuals, individuals having gender identity disorder, and other persons who may wish to conceal their penis.

Furthermore, in the present embodiment, the penis is secured in a state in which the foreskin is retracted to expose the glans penis, making it possible to avoid circumstances in which pubic hair becomes entangled with the foreskin that covers the glans penis in cases of incomplete phimosis, and making it possible to contribute to correction of phimosis.

Moreover, the present embodiment admits of any number of variations without departing from the essence of the present invention, it being possible to alter the size and/or shape of the respective component members as appropriate in accordance with the build of the wearer; and the strap-like cloth members are not limited to being long, thin, and strap-like in shape, it being possible that they be triangular or of other such shape of varying width.

Furthermore, to capture the corona glandis portion of the penis, the shape of the insertion hole into which the glans portion is inserted may be triangular or square or of other such rectangular shape, or a slit of size on the order of that which will permit the glans portion to pass therethrough may be employed. However, note that this must be shaped so as to function such that, with the undergarment installed, the front edge portion of this insertion hole captures the front side of the corona glandis portion and the penis is inhibited from returning to the front.

(Variation 1)

A first variation, this being a variation on the first embodiment, is next described with reference to the drawings. FIG. 4 is a perspective view of a male undergarment associated with the present first variation. Because male undergarment 11 associated with the present first variation differs in constitution from male undergarment 10 of the foregoing first embodiment with respect to the point that the present first variation has one strap-like cloth member, the constitution being in other respects similar, like constituents are assigned like numerals and description thereof is omitted.

As shown in FIG. 4, male undergarment 11 associated with the present first variation is equipped with a first strap-like cloth member 22 constituting a retainer main body, and with a waist cord 20 for installing the retainer main body on a human body. While the present first variation having such simple constitution is not provided with another cloth member for covering the exposed glans penis which protrudes from insertion hole 22*a* of first strap-like cloth member 22, it is nonetheless capable of providing similar operation and effect as the foregoing first embodiment with respect to securing of the penis. Furthermore, male undergarment 11 associated with the present first variation being of simple constitution, it permits great reduction in manufacturing cost.

(Variation 2)

A second variation, this being a variation on the first embodiment, will next be described with reference to the drawings. FIG. 5 is a perspective view of a male undergarment associated with the present second variation. FIGS. 6A, 6B, and 6C are respectively plan views of strap-like cloth members 22, 25, 26 which make up the main body, the respective strap-like cloth members 22, 25, 26 being shown as they would appear when spread out, of the male undergarment associated with the present second variation. Because male undergarment 12 associated with the present second variation differs in constitution from male undergarment 10 of the foregoing first embodiment with respect to the point that in the present second variation the retainer main body comprises three strap-like cloth members, the constitution being in other respects similar, like constituents are assigned like numerals and description thereof is omitted.

As shown in FIG. 5, male undergarment 12 associated with the present second variation is equipped with a first strap-like cloth member 22, a second strap-like cloth member 25, and a third strap-like cloth member 26 that is mounted to the inside of the first strap-like cloth member 22, these constituting a retainer main body.

As shown in FIG. 5 and FIG. 6C, third strap-like cloth member 26 has, at the front face thereof, an insertion hole 26*a* similar to the foregoing insertion hole 22*a*. At the time that this male undergarment 12 is worn, the penis is first made to pass through this insertion hole 26*a*, and the glans portion of the penis is thereafter made to pass through insertion hole 22*a* as described above. By so doing, a region corresponding roughly to the center of the penis will be retained by the edge region of insertion hole 26*a*, making it possible to further secure the penis even more stably than was the case with male undergarment 10 of the foregoing first embodiment.

(Variation 3)

A third variation, this being a variation on the first embodiment, is next described with reference to the drawings. FIG. 7 is a perspective view of a male undergarment associated with the present third variation. FIG. 8 is a view, as seen from the front after removing the cover, of the male undergarment associated with the present third variation. Because male undergarment 13 associated with the third variation differs in constitution from male undergarment 10 of the foregoing first embodiment with respect to the points that in the third variation the waist cord comprises a plurality of members, and a cover is provided that covers the retainer main body, the constitution being in other respects similar, like constituents are assigned like numerals and description thereof is omitted.

The waist cord in the third variation is formed from rubber cords having elasticity, and as shown in FIG. 7 and FIG. 8 comprises first hoop-like cord 21-1; second hoop-like cord 21-2; and connecting cord 23, which connects first hoop-like cord 21-1 and second hoop-like cord 21-2 at four places. When the waist cord having such constitution is worn on a human body, as shown in FIG. 8, the central regions at the front and back of second hoop-like cord 21-2 where second strap-like cloth member 25 is connected thereto are pulled downward by second strap-like cloth member 25. The undergarment itself therefore permits a large amount of deformation when worn, allowing it to fit persons of a wide variety of sizes, and in addition, elasticity exhibited by the hoop-like cords 21-1, 21-2 makes it possible to more firmly secure the undergarment to the human body.

Furthermore, cover 27 is a rectangularly shaped piece of cloth mounted outside the retainer main body so as to cover and conceal the retainer main body, the front and back edges in the long direction thereof being connected to first hoop-like cord 21-1. Furthermore, the width of cover 27 is somewhat shorter than the length of the long axis of the waist cord, which assumes a more or less elliptical shape when worn, making it possible to more or less cover and conceal the crotch area.

The present third variation having such constitution provides similar operation and effect as the male undergarment of the first embodiment, and furthermore, also makes it possible to cause the undergarment to definitively fit the human body, and in addition, makes it possible by means of a cover to reduce exposure of the crotch area.

(Variation 4)

A fourth variation, this being a variation on the first embodiment, will next be described with reference to the drawings. FIG. 9 is a perspective view of a male undergarment associated with the present fourth variation. As shown in same drawing, the constitution of male undergarment 14 associated with the fourth variation differs from that of male undergarment 10 of the first embodiment with respect to the point that in the fourth variation a ring 31 is provided at the rear portion of waist cord 30.

First strap-like cloth member 32, which is provided with insertion hole 32*a*, and second strap-like cloth member 35 are constituted from a single strap-like member that is folded over where it is made to pass through ring 31. Therefore, by allowing the first and second strap-like cloth members 32, 35 to slide relative to ring 31, the present fourth variation permits those respective lengths to be varied, making it possible to easily cause male undergarment 14 to fit the build of the wearer.

(Variation 5)

A fifth variation, this being a variation on the first embodiment, will next be described with reference to the drawings. FIG. 10 is a perspective view of a male undergarment associated with the present fifth variation. As shown in same drawing, male undergarment 15 associated with the present fifth variation adds to the foregoing fourth variation with provision of a ring 31 at the front of waist cord 30' as well.

First strap-like cloth member 32' and second strap-like cloth member 35' are connected in integral fashion at both front and back so as to constitute a single continuous loop. Therefore, at male undergarment 15, first and second strap-like cloth members 32', 35' are capable of sliding at both rings 31, 31, which are mounted at the front and back of waist cord 30', and it is also possible to alter the location of insertion hole 32*a'*.

Because in the present fifth variation having such constitution it is possible to move insertion hole 32*a'* in correspondence to such things as the shape of the penis of the wearer, it can be made to better fit the build of the wearer.

(Variation 6)

A sixth variation, this being a variation on the first embodiment, will next be described with reference to the drawings. FIG. 11 is a perspective view of a male undergarment associated with the present sixth variation. As shown in same drawing, the constitution of male undergarment 16 associated with the sixth variation differs as compared with the foregoing fourth variation with respect to the point that instead of second strap-like cloth member 35 the sixth variation employs a second strap-like cloth member 36 that is triangular in shape, width thereof increasing as one proceeds from the back to the front.

The present sixth variation, in addition to the operation and effect of the foregoing fourth variation, has the advantage that covering by second strap-like cloth member 36 makes it possible to also cover and conceal the scrotum, pubic hair, and so forth.

(Variation 7)

A seventh variation, this being a variation on the first embodiment, will next be described with reference to the drawings. FIG. 12 is a perspective view of a male undergarment associated with the present seventh variation. As shown in same drawing, the constitution of male undergarment 17 associated with the seventh variation differs as compared with the foregoing third variation with respect to the point that the seventh variation is also provided with front flap 28 and with clips 29, which are attached at the front of second hoop-like cord 21-2.

The present seventh variation, in addition to the operation and effect of the foregoing third variation, is such that gripping prescribed locations at cover 27 and front flap 29 with clips 29 makes it possible to adjust elasticity of second hoop-like cord 21-1, and to adjust the force with which the retainer main body is stretched by second hoop-like cord 21-1. Accordingly, male undergarment 17 can be better made to appropriately fit the lower body of the wearer. Furthermore, as front flap 28 makes the external appearance not unlike that of a string loincloth, it is also superior from an aesthetic perspective.

(2) Embodiment 2

A second embodiment of the present invention is next described with reference to the drawings. FIG. 13 is a perspective view of a penis retainer associated with the second embodiment. FIG. 14 is a schematic diagram showing schematically how a side edge portion of the penis retainer associated with the second embodiment is stitched together.

As shown in FIG. 13, penis retainer 50 associated with the second embodiment comprises tubular cloth member 55, which is a retainer main body; front connecting cord 58*a*, which is a connecting member for installing the retainer main body on a human body, one end of front connecting cord 58*a* being attached to the lower side of a front open portion of tubular cloth member 55; clip 59*a*, which is attached to the tip of front connecting cord 58*a*; back connecting cord 58*b*, one end of which is attached to the upper side of a back open portion of tubular cloth member 55; and clip 59*b*, which is attached to the tip of back connecting cord 58*b*.

In the present embodiment, as shown in FIG. 13, tubular cloth member 55 is installed on a human body by respectively fastening these clips 59 of penis retainer 50 to the front center portion and the back center portion of waist cord 51, which is mounted on the waist region of the human body. Of course, connecting member(s) for installing tubular cloth member 55 thereon may be secured at any desired location(s), and article(s) having any of a wide variety of constitution(s) may be employed as the connecting member(s) itself/themselves. For example, connecting cord(s) 58 might be extended and secured at the shoulders by wrapping around the neck.

Tubular cloth member 55 is constituted in tubular fashion by stitching together the edge regions at either side in the long direction of three first through third rectangular cloth members 56*a* through 56*c*. As shown in FIG. 14, while first rectangular cloth member 56*a*, situated at the topmost location, and second rectangular cloth member 56*b*, situated centrally, are of approximately the same size, the edge regions at either side where the two overlap are stitched together in misaligned such fashion that second rectangular cloth member 56*b* is on the order of 3 cm to the front. Moreover, as first rectangular cloth member 56*a* and second rectangular cloth member 56*b* are not stitched together at any location other than the edge regions at either side in the long direction thereof, the penis may be inserted in the tubular space bounded by the two when installed on the human body.

Furthermore, the front (left as seen in the drawing) edges of central second rectangular cloth member 56*b* and bottommost third rectangular cloth member 56*c* are at the same location, but because third rectangular cloth member 56*c* is on the order of 4 cm longer, the back edge of third rectangular cloth member 56*c* is misaligned with the back edge of second rectangular cloth member 56*b* so as to be on the order of 4 cm to the back relative thereto, and so as to be at the same location as the back edge of first rectangular cloth member 56*a*.

As shown in FIG. 14, second rectangular cloth member 56*b* and third rectangular cloth member 56*c* are such that, except for a portion (a region on the order of 4 cm toward the front from the back edge of second rectangular cloth member 56*b*), the edge regions at either side in the long direction thereof where the two overlap are stitched together. The region not stitched together constitutes side opening(s) 60, it being possible to expose the tip of the glans penis from such side opening(s) 60 during urination. Note that while the edge in the short direction at the front of second rectangular cloth member 56*b* is stitched to third rectangular cloth member 56*c*, the edge in the short direction at the back of second rectangular cloth member 56*b* is not stitched to third rectangular cloth member 56*c*.

Furthermore, the edge regions at either side in the long direction of first rectangular cloth member 56*a* and third rectangular cloth member 56*c* are stitched together at location(s) where second rectangular cloth member 56*b* is not present at the back portion of tubular cloth member 55. Of course, the edges in the short direction at the back of first rectangular cloth member 56*a* and third rectangular cloth member 56*c* are not stitched together but are left open.

Next, when penis retainer 50 having such constitution is installed on a human body, the penis is first inserted in the tubular space straddled by first rectangular cloth member 56*a* and second rectangular cloth member 56*b*. At this time, it is necessary that the foreskin be retracted and the exposed corona glandis portion be inserted to a location beyond the back edge of second rectangular cloth member 56*b*.

After the penis is thus inserted within tubular cloth member 55, clips 59*a*, 59*b* are respectively attached to the front and back of waist cord 51 to complete installation. Note that when clip 59*b* is attached to the rear portion of waist cord 51 it is necessary that this be carried out while pulling the penis backward. Once installed, the front edge region of tubular cloth member 55 is pulled upward and to the front, and the back edge region thereof is pulled upward and to the back, by way of connecting cords 58.

By so doing, the penis itself is reliably secured as a result of being tucked into the crotch area by the inside bottom surface (top surface of the second rectangular cloth member) of tubular cloth member 55. Furthermore, although there is a tendency for the penis to attempt to return to the front because it is retained by tubular cloth member 55 in a state in which it is pulled toward the back, it is unable to return thereto because the front side of the corona glandis is captured by the lower side of the end edge portion at the back of second rectangular cloth member 56*b*. Furthermore, the glans portion that protrudes rearward from the back end portion of second rectangular cloth member 56*b* is prevented from being exposed to the exterior, inasmuch as it is covered by third rectangular cloth member 56*c*.

Thus, in accordance with the second embodiment, because as was the case with the first embodiment the front side of a region from the base of the penis to the corona glandis is pressed on by surface(s) from the second rectangular cloth member, and because the corona glandis is captured and secured by an edge region at the back of the second rectangular cloth member, it is possible to secure the penis in stable fashion without imparting pain or discomfort to the wearer.

Furthermore, the penis retainer associated with the second embodiment also makes it possible to retain the penis in a state in which the glans penis, from which the foreskin has been retracted, has been pulled backward from below and tucked into the crotch area, and makes it possible for the penis and the scrotum to be reliably secured with respect to the human body. The second embodiment is thus also capable of providing various operations and effects as was the case with the first embodiment.

While the second embodiment has been described above in detail, the present embodiment also admits of any number of variations without departing from the essence of the present invention. For example, whereas the second embodiment employed a tubular cloth member 55 that was open at the both the front and back ends, these being the edges in the short direction thereof, where it is desired that the penis be more definitively covered and concealed by the penis retainer it is also possible to employ a constitution in which the open end at the back of the tubular cloth member is stitched together and closed.

Furthermore, the respective materials making up the penis retainer may be varied as appropriate. For example, cloth member(s) that is/are highly flexible horizontally and vertically and that is/are formed from polyurethane, nylon, or other such synthetic fiber, these being stocking materials used for panty stockings, may be employed as material(s) for tubular cloth member 55. Where highly flexible material(s) is/are used, to achieve good retaining ability at tubular cloth member 55 it is desirable that the size(s) thereof be made small.

(Variation 8)

An eighth variation, this being a variation on the second embodiment, will next be described with reference to the drawings. FIG. 15 is a perspective view of a penis retainer associated with the eighth variation. Penis retainer 53 associated with the eighth variation comprises tubular cloth member 57; front connecting cord 58*a*, one end of which is attached to the lower side of a front open portion of tubular cloth member 57; clip 59*a*, which is attached to the tip of front connecting cord 58*a*; back connecting cord 58*b*, one end of which is attached to the upper side of a back open portion of tubular cloth member 57; and clip 59*b*, which is attached to the tip of back connecting cord 58*b*.

Because penis retainer 53 associated with the present eighth variation is such that tubular cloth member 57 differs in constitution from tubular cloth member 55 associated with the foregoing second embodiment with respect to the point that in the present eighth variation the tubular cloth member 57 is made up of two rectangular cloth members of the same size, the constitution being in other respects similar, like constituents are assigned like numerals and description thereof is omitted.

As shown in FIG. 15, the eighth variation is such two rectangular cloth members of the same size are arranged such that one lies over the other, the edge regions at either side in the long direction thereof being stitched together to achieve a tubular constitution. Furthermore, the two edges in the short direction thereof are not stitched together, both the front and back ends of tubular cloth member 55 being open.

When penis retainer 53 having such constitution is installed on a human body, as was the case in the foregoing second embodiment, the penis is inserted from the front of tubular cloth member 57 in the tubular space straddled by the two rectangular cloth members. At this time, it is necessary that the foreskin be retracted and the exposed corona glandis portion be inserted to a location beyond the back edge of the lower rectangular cloth member, i.e., that the penis be inserted until the entire glans penis is exposed as it protrudes from the opening at the back of tubular cloth member 57.

As was the case with the foregoing second embodiment, when penis retainer 53 is installed on a human body, the penis is reliably secured, being tucked into the crotch area by the inside bottom surface of the tubular cloth member 57 in a state in which the penis is pulled toward the back. In the event that the penis attempts to return to the front, it is unable to return thereto because the front side of the corona glandis is captured by the lower side edge portion at the back of tubular cloth member 57.

The present eighth variation therefore provides operation and effect similar to those at the foregoing second embodiment, and also makes it possible to provide a penis retainer having simple constitution and low cost.

A ninth variation, this being a variation on the second embodiment, will next be described with reference to the drawings. FIG. 16 is a perspective view of a penis retainer associated with the ninth variation. Because penis retainer 65 associated with the ninth variation differs in constitution from the foregoing second embodiment with respect to the point that in the ninth variation the size(s) and material(s) at tubular cloth member 66 differ from those of tubular cloth member 55 at the foregoing second embodiment, and with respect to the point that connecting straps 68*a*, 68*b* are employed as connecting members in the ninth variation instead of the connecting cords 58 and the clips 59 of the foregoing second embodiment, the constitution being in other respects similar, like constituents are assigned like numerals and description thereof is omitted.

The structure of tubular cloth member 66 associated with the present ninth variation is similar to that of tubular cloth member 55 at the foregoing second embodiment, but cloth member(s) that is/are highly flexible horizontally and vertically and that is/are formed from polyurethane, nylon, or other such synthetic fiber, these being stocking materials used for panty stockings, is/are employed as material(s), the constitution being such that the size(s) thereof is/are such as to make the tube diameter more or less half what it was.

If highly flexible material(s) such as stocking material(s) is/are used, because it will be possible to retain the penis in such manner that it is enveloped from the entire circumference therearound, since the force applied to the penis will be distributed when the penis is tucked into the crotch area thereabove by tubular cloth member 66, it will be possible to greatly reduce the sensation of the penis being pressed on per se as perceived by the wearer, and it will be possible to give the wearer a naturally installed feeling.

Note that where two-way stretch material(s) that is/are highly flexible horizontally and vertically is/are used as material(s) for tubular cloth member 66, it is possible to employ a wide variety of materials. Furthermore, in the present ninth variation, connecting straps 68 are employed as connecting members for installing tubular cloth member 66 on a human body, front connecting strap 68*a* being formed by extending in integral fashion the flexible material that makes up the bottom surface of tubular cloth member 66, and back connecting strap 68*b* being formed by extending in integral fashion the flexible material that makes up the top surface of tubular cloth member 66.

Furthermore, whereas connecting straps 68 were secured by stitching to waist cord 51 in the present ninth variation, it is possible to adopt a constitution in which these are secured in detachable fashion by means of buttons, surface fasteners, or the like. The present ninth variation thus provides operation and effect similar to those at the foregoing second embodiment, and also makes it possible to provide even more comfort to the wearer.

EXPLANATION OF REFERENCE NUMERALS

Figure 1:
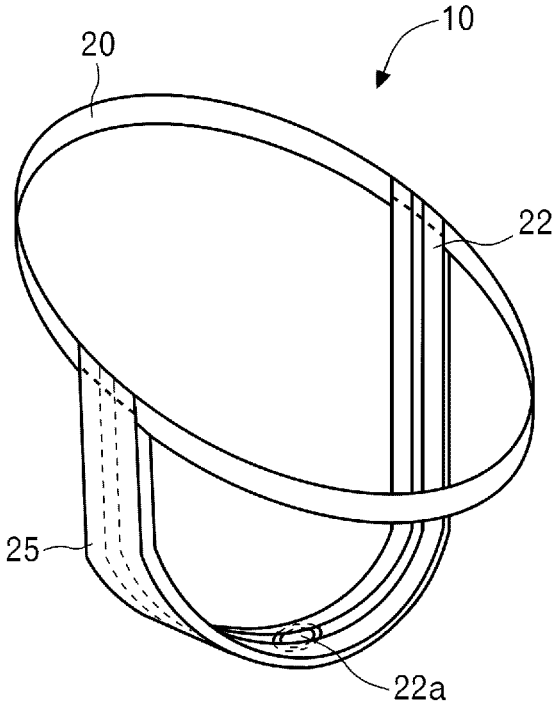
FIG. 1 is a perspective view of a male undergarment associated with the first embodiment.
Figure 2A:
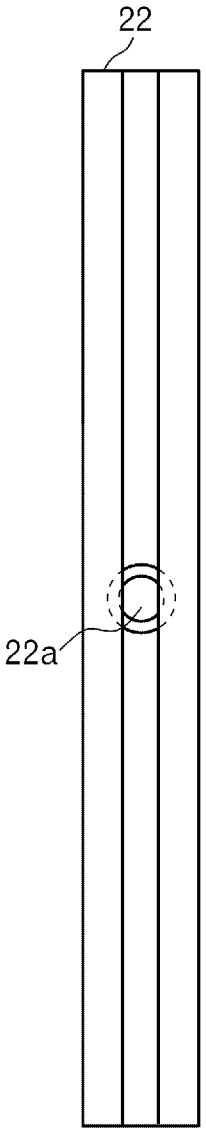
FIGS. 2A and 2B respectively show strap-like cloth members 22, 25 which make up a retainer main body in the male undergarment associated with the first embodiment, the respective strap-like cloth members 22, 25 of the retainer main body being shown as they would appear when spread out.
Figure 2B:
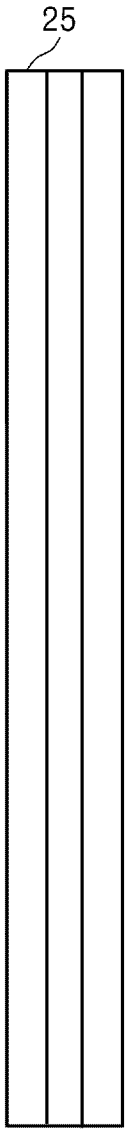
Figure 3:
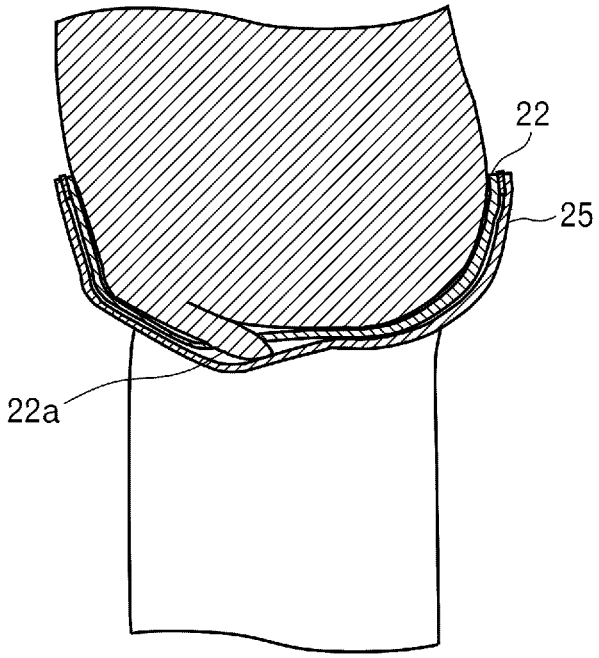
FIG. 3 is a sectional view showing the male undergarment associated with the first embodiment as it appears when worn.
Figure 4:
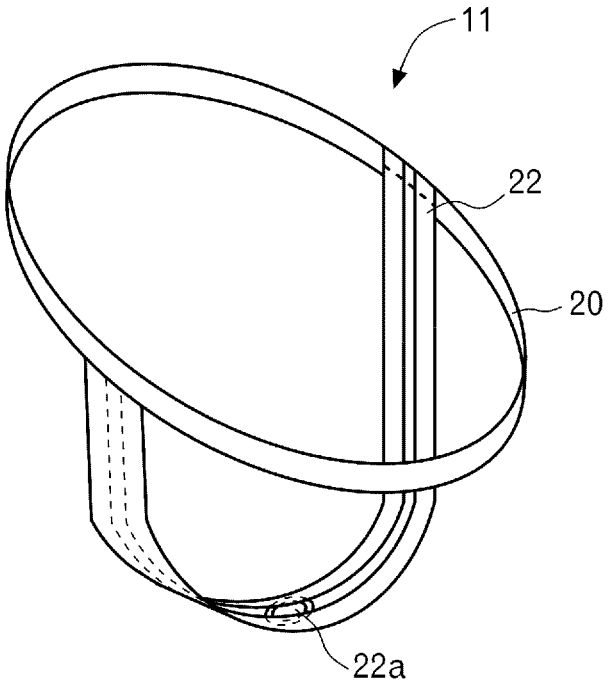
FIG. 4 is a perspective view of a male undergarment associated with a first variation, this being a variation on the first embodiment.
Figure 5:
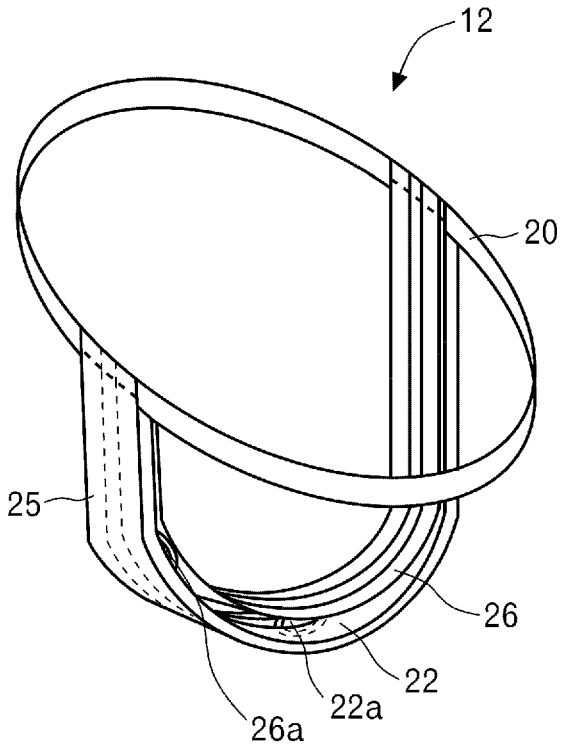
FIG. 5 is a perspective view of a male undergarment associated with a second variation, this being a variation on the first embodiment.
Figure 6C:
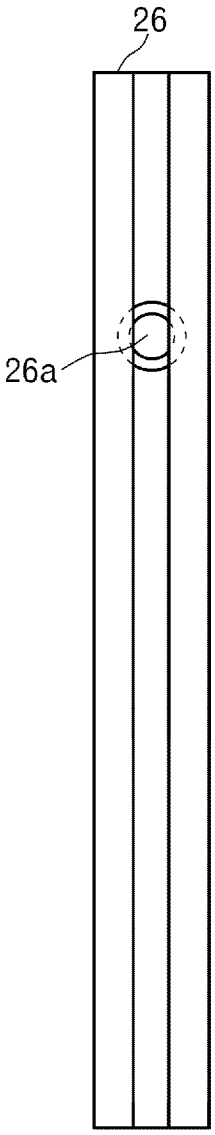
FIGS. 6A, 6B, and 6C respectively show strap-like cloth members 22, 25, 26 which make up a retainer main body in the male undergarment associated with the second variation, this being a variation on the first embodiment, and the respective strap-like cloth members 22, 25, 26 of the retainer main body being shown as they would appear when spread out.
Figure 6A:
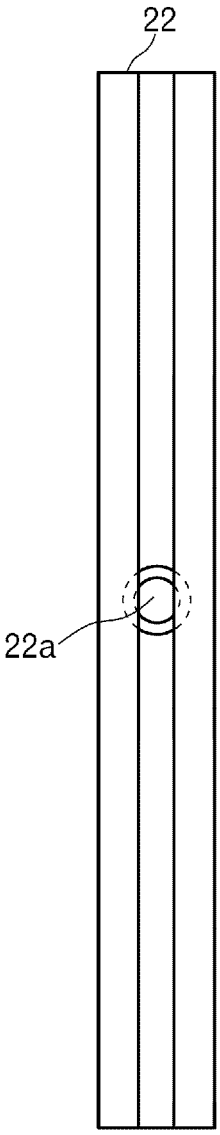
Figure 6B:
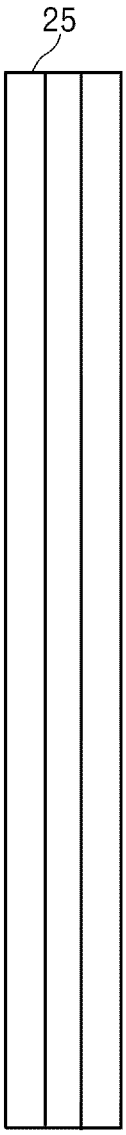
Figure 7:
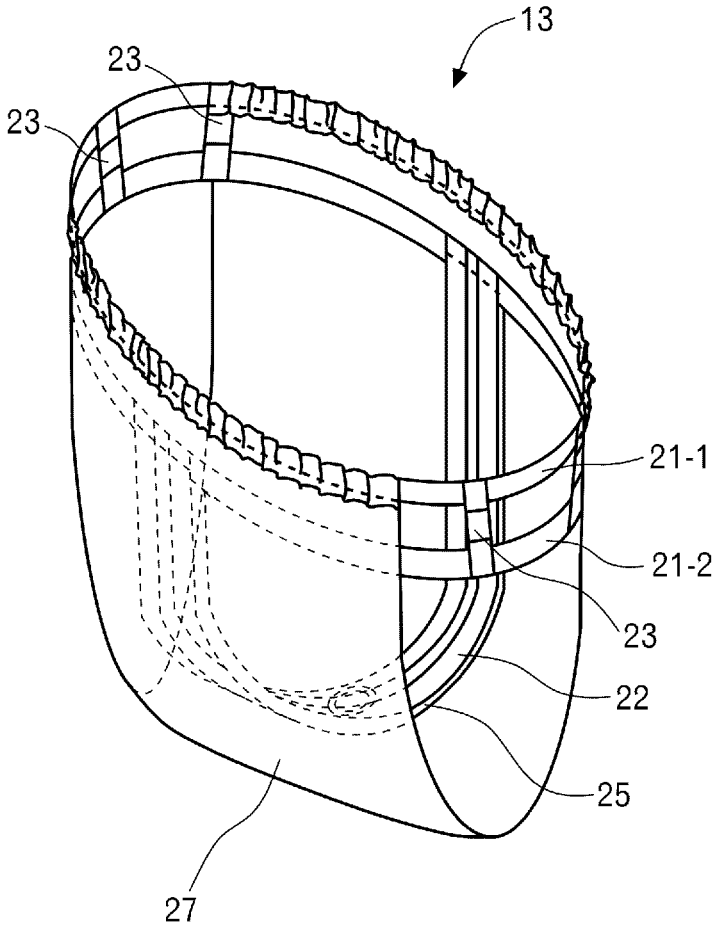
FIG. 7 is a perspective view of a male undergarment associated with a third variation, this being a variation on the first embodiment.
Figure 8:
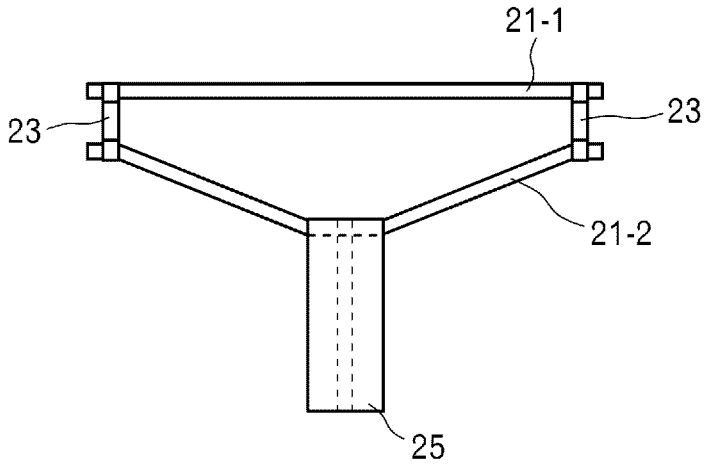
FIG. 8 is a view, as seen from the front after removing the cover, of the male undergarment associated with the third variation, this being a variation on the first embodiment.
Figure 9:
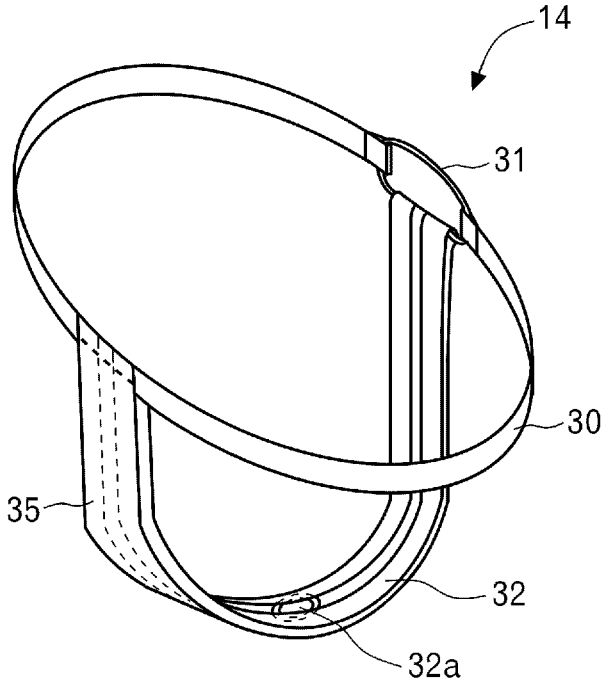
FIG. 9 is a perspective view of a male undergarment associated with a fourth variation, this being a variation on the first embodiment.
Figure 10:
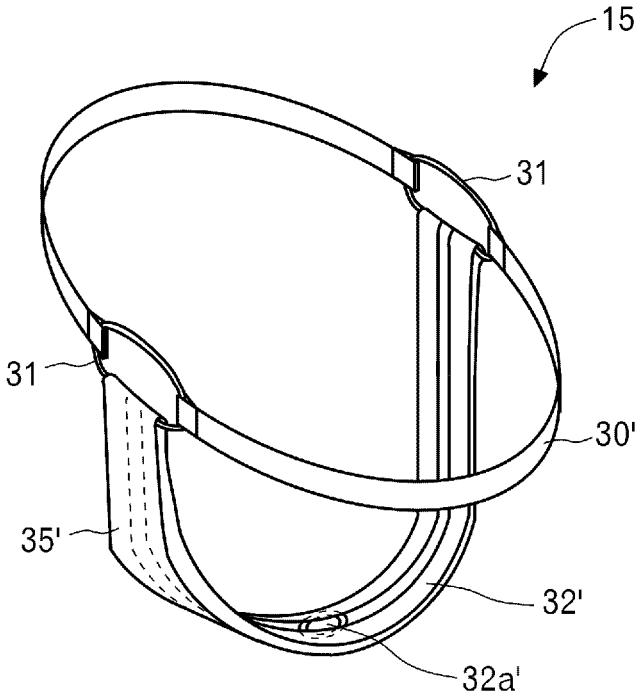
FIG. 10 is a perspective view of a male undergarment associated with a fifth variation, this being a variation on the first embodiment.
Figure 11:
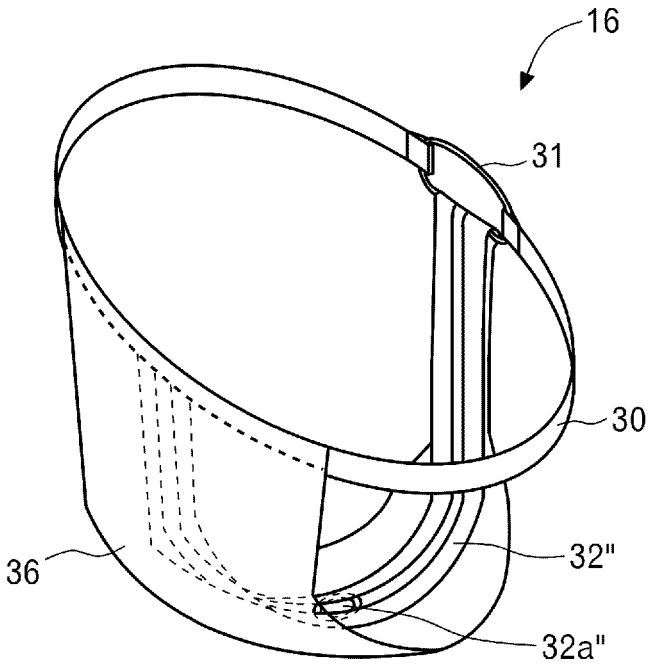
FIG. 11 is a perspective view of a male undergarment associated with a sixth variation, this being a variation on the first embodiment.
Figure 12:
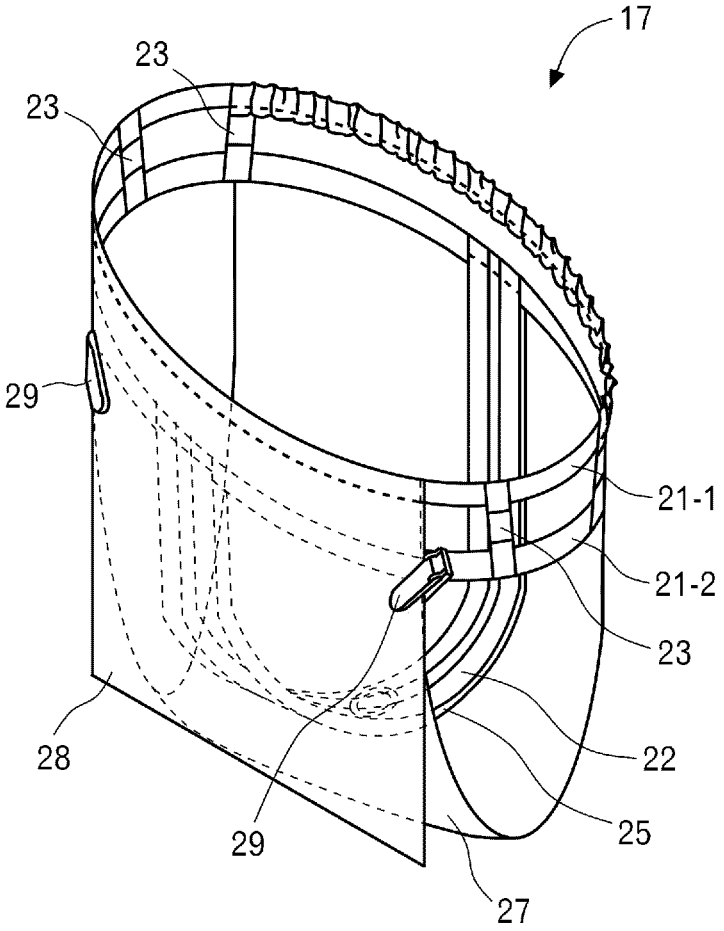
FIG. 12 is a perspective view of a male undergarment associated with a seventh variation, this being a variation on the first embodiment.
Figure 13:
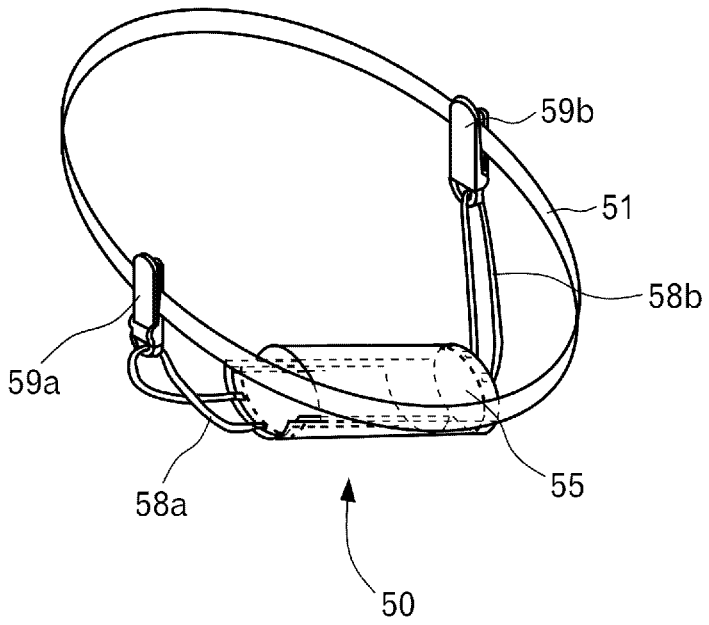
FIG. 13 is a perspective view of a penis retainer associated with a second embodiment.
Figure 14:
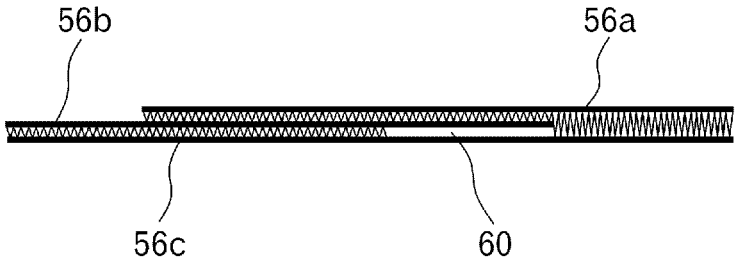
FIG. 14 is a schematic diagram showing schematically how a side edge portion of the penis retainer associated with the second embodiment is stitched together.
Figure 15:
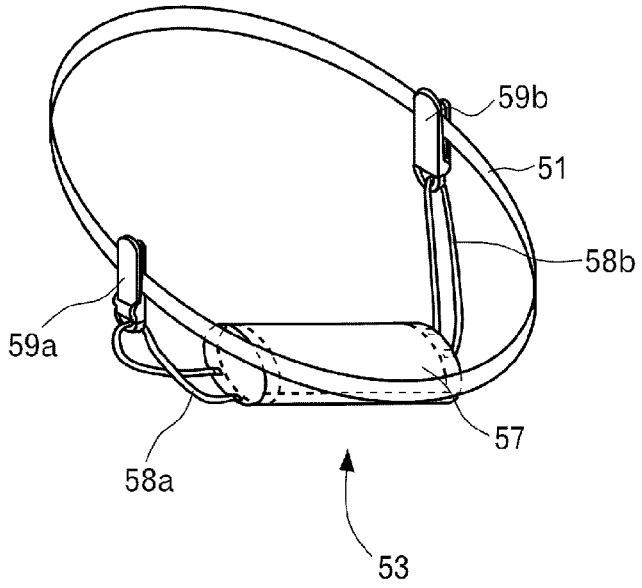
FIG. 15 is a perspective view of a penis retainer associated with an eighth variation, this being a variation on the second embodiment.
Figure 16:
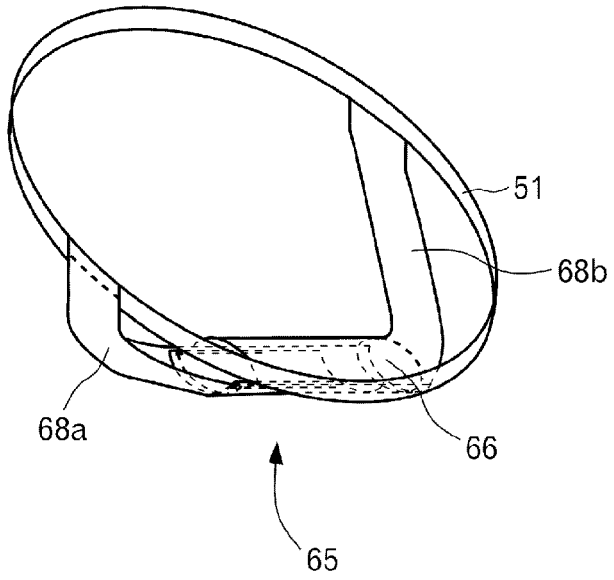
FIG. 16 is a perspective view of a penis retainer associated with a ninth variation, this being a variation on the second embodiment.

10 Male undergarment (penis retainer)
20 Waist cord
22 First strap-like cloth member
22*a* Insertion hole
25 Second strap-like cloth member
50 Penis retainer
51 Waist cord
55 Tubular cloth member
56 Rectangular cloth members
58 Connecting cords
59 Clips

The invention claimed is:

1. A penis retainer comprising:

a tubular cloth member mounted below a crotch when installed on a human body and allowing a penis to be inserted into an interior space from a front opening thereof; and a connecting member for installing the tubular cloth member on the human body, the connecting member having a front connecting cord, one end of which is attached to a front end of the tubular cloth member; and a back connecting cord, one end of which is attached to a back end of the tubular cloth member;

wherein the front connecting cord is attached to the front end of the tubular cloth member at a location below the interior space of the tubular cloth member.

2. A penis retainer according to claim 1 wherein there is also an opening formed at a back end of the tubular cloth member.

3. A penis securing method comprising:

a step in which a tubular cloth member is installed on a human body so as to be mounted below a crotch;

a step in which a penis is inserted into an interior space of the tubular cloth member from a front opening of the tubular cloth member; and a step in which the penis is secured by tucking the penis into the crotch by pulling the penis backward from below and causing a foreskin to retract so as to completely expose a glans penis, and with the penis pulled backward in this state, causing an inside bottom surface of the tubular cloth member to come in contact with and press upward on a front side of a region from a vicinity of a base of the penis to a corona glandis thereof;

wherein a connecting member is employed for installing the tubular cloth member on the human body, the connecting member having a front connecting cord, one end of which is attached to a front end of the tubular cloth member; and a back connecting cord, one end of which is attached to a back end of the tubular cloth member; and wherein the front connecting cord is attached to the front end of the tubular cloth member at a location below the interior space of the tubular cloth member.

4. A penis securing method comprising:

a step in which a tubular cloth member is installed on a human body so as to be mounted below a crotch;

a step in which a penis is inserted into an interior space of the tubular cloth member from a front opening of the tubular cloth member; and a step in which the penis is secured by tucking the penis into the crotch by pulling the penis backward from below and causing a foreskin to retract so as to completely expose a glans penis, and with the penis pulled backward in this state, causing an inside bottom surface of the tubular cloth member to come in contact with and press upward on a front side of a region from a vicinity of a base of the penis to a corona glandis thereof;

wherein a connecting member is employed for installing the tubular cloth member on the human body, the connecting member having a front connecting cord, one end of which is attached to a front end of the tubular cloth member; and a back connecting cord, one end of which is attached to a back end of the tubular cloth member;

wherein the front connecting cord is attached to the front end of the tubular cloth member at a location below the interior space of the tubular cloth member; and wherein there is also an opening formed at a back end of the tubular cloth member.

* * * * *